United States Patent [19]

Ushkow

[11] 3,938,412

[45] Feb. 17, 1976

[54] AMPULE SCORER

[75] Inventor: Meyer Ushkow, West Palm Beach, Fla.

[73] Assignee: David E. Ushkow, Flushing, N.Y.

[22] Filed: June 4, 1973

[21] Appl. No.: 366,716

[52] U.S. Cl. ..... 83/11; 225/96; 30/94

[51] Int. Cl.[2] ..... B26D 3/08

[58] Field of Search ..... 51/205 WG, 214; 30/92, 30/164.95, 94; 10/1 B; 83/6, 11; 225/94, 96, 103

[56] References Cited

UNITED STATES PATENTS

| | | | |
|---|---|---|---|
| 271,250 | 1/1883 | Kinney | 30/94 |
| 1,169,579 | 1/1916 | Strauss | 30/164.95 X |
| 1,584,572 | 5/1926 | Bello | 51/205 WG |
| 2,482,833 | 9/1949 | Biro | 51/205 WG |
| 2,488,956 | 11/1949 | Yeskett | 51/205 WG X |
| 2,686,362 | 8/1954 | Dancey | 30/92 |
| 2,869,413 | 1/1959 | Anderson | 30/94 X |
| 3,051,360 | 8/1962 | Ring | 225/96 |

*Primary Examiner*—Willie G. Abercrombie
*Assistant Examiner*—Leon Gilden

[57] ABSTRACT

Glass ampules are individual hermetically sealed units containing liquid medication. Some United States manufactured ampules and a large proportion of foreign ampules are available as unscored. In order to open and withdraw the contents of such ampules they have to be scored. This is generally done with a small steel file.

The proposed invention consists of a guillotine type device wherein a small steel file is held in a slit arrangement in the lower and upper portion of the guillotine on which the ampule neck is rotated thereby scoring the ampule neck which is subsequently snapped off. The lower and upper parts of the guillotine have two (2) guide posts which permit the top portion thereof to move up and down to accomodate and score all size ampules from 1cc to 50cc inclusive.

1 Claim, 3 Drawing Figures

FIG. 1
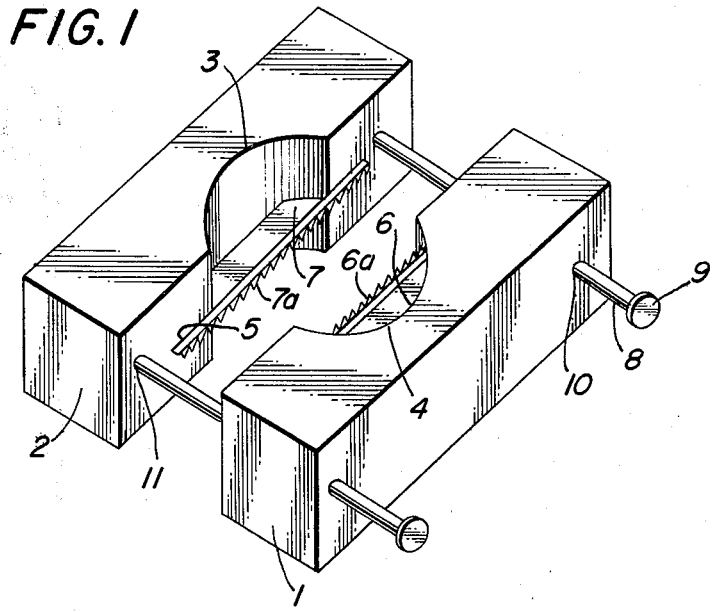
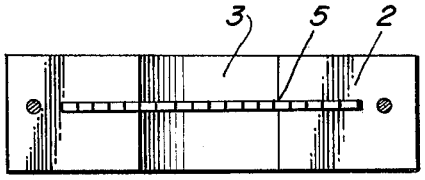
FIG. 2
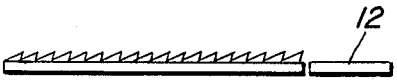
FIG. 3

AMPULE SCORER

The present invention concerns an ampule scorer.

There are known a number of ampule cutters or scorers such as e.g. in U.S. Pat. Nos. 1,584,572-Bellow; 2,199,807 Moreira; and 2,488,956-Yeskette.

All these ampule cutters score the glass in a superficial and uneven manner only and in order to score a deeper line, which is required to get a clean break of the glass, great pressure on the glass tube or ampule must be applied. It often happens that the ampule or glass tube breaks in the operator's hand, causing injury and waste.

In the Bellow Patent the chief drawback is the fact that the ampule can not be guided while being rotated to effect an exact scoring line. The same holds true for the Yeskett patent. While in the Moreira patent only glass tubes can be cut, it is not suitable for the scoring or cutting of ampules whose head has indentations at its neck, since this patent is adjustable for the length of glass tubes only which tubes all have the same diameter throughout.

It is the object of the present invention to provide means for scoring ampules of all sizes with a view to making the breaking open of said ampules easy, exact, and to prevent any jagged edges or breaking of fine pieces of glass, which could possibly impair the liquid contained in said ampules or injure the person handling it.

The invention consists in an ampule scorer comprising two elongated bodies, one being movable relative to the other along guide means, a flat file being removably inserted in the adjacent flat edges of said bodies in such manner that both files lie in one plane with their teeth facing each other, and remain in this position when one body is moved relative the other.

When an ampule is to be scored the two bodies are removed for a sufficient distance from each other so that the head of the ampule can be inserted between said files, the bodies are held one against the other without undue pressure and the ampule is turned between the two files so that a perfect scoring line can be effected.

The invention is illustrated, by way of example only, in the accompanying drawings in which:

FIG. 1 is a perspective view of the ampule scorer according to the invention;

FIG. 2 is a plan view of one body thereof;

FIG. 3 is a partial view of a file and the sheath for its ends.

The ampule scorer according to the invention comprises two bodies 1 and 2, having semi-circular cut-outs 3 and 4, respectively, in their longitudinal edge, as well as a slot 5 along the median line of said cut-out, the slot 5 extending at either end of the cut-outs 3 and 4.

A file 6, 7, respectively, is inserted into slots 5 in such manner that its teeth 6*a*, 7*a*, respectively, lie substantially flush with the longitudinal surfaces of bodies 1 and 2. The bodies 1 and 2 are movable relative each other, pins 8, having removable stops 9 at their outer ends, extending through bores 10 in body 1 and being fixed within bores 11 in body 2 with their inner ends.

The length of the pin is such as to permit the bodies, i.e. the files to be removed from each other for a distance of at least 1–1¼ inches, i.e. for a space which will accommodate any diameter ampule or glass tube.

According to a special feature of the invention, the files 6, 7 have very fine teeth and are positioned in the bodies so that the direction of the teeth 6*a* is opposite to that of teeth 7*a*.

In order to use the ampule scorer it is placed with its body 2 on a solid surface, i.e. a table or desk. The body 1 is moved upwardly along pins 8 until enough space between files 6 and 7 is obtained to insert the head of an ampule therein. Thereafter a slight pressure is applied on body 1 and the ampule is moved in a reciprocal rotating movement, whereby a proper scoring line is obtained. Thereafter body 1 is lifted to remove the ampule and the tip of the head of the ampule can be broken off in a known manner.

In order to replace the files, the stops 9 are removed from pin 8 so that body 1 can be withdrawn, the worn files are slipped out of their slots 5 and are replaced by new ones, whereafter body 1 is again threaded onto pins 8 and stoppers 9 are replaced.

In order to assure a perfect seat for the files their ends may be covered with sheaths 12 of any suitable material, even Scotch-Tape (T.M.)

Since some ampules are to be scored and broken off at the joint between their bodies and their neck, the provision of the cutouts 3 and 4, which should have at least a diameter of 1⅛ inches to accommodate the largest size ampule, prevents any interference of the bodies with the shoulder of the ampule.

It can be seen that ampules of all known sizes can be easily and quickly scored with the ampule scorer of the simple construction above described.

I claim:

1. A device for scoring ampoules for subsequent breakage comprising two elongated body portions formed with facing semi-circular recesses, secured within the recesses are relatively thin files members lying in the same plane whose teeth are faced in opposite directions such that a contra-rotating motion imparted to the ampoule will evenly score the neck for subsequent breakage, said recesses shaped to accomodate various dimensioned ampoule tip bulges and body portions on opposite sides of said file members.

* * * * *